US007647221B2

(12) United States Patent
Michener

(10) Patent No.: US 7,647,221 B2
(45) Date of Patent: Jan. 12, 2010

(54) AUDIO LEVEL CONTROL FOR COMPRESSED AUDIO

(75) Inventor: James A. Michener, Grass Valley, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 827 days.

(21) Appl. No.: 10/426,664

(22) Filed: Apr. 30, 2003

(65) Prior Publication Data

US 2007/0255556 A1 Nov. 1, 2007

(51) Int. Cl.
*G10L 19/00* (2006.01)

(52) U.S. Cl. ..... 704/200.1

(58) Field of Classification Search ..... 704/200.1
See application file for complete search history.

(56) References Cited

U.S. PATENT DOCUMENTS

| | | | |
|---|---|---|---|
| 3,627,914 | A | 12/1971 | Davies |
| 3,843,942 | A | 10/1974 | Pierret et al. |
| 4,934,483 | A | 6/1990 | Kallergis |
| 5,337,041 | A | 8/1994 | Friedman |
| 5,363,147 | A | 11/1994 | Joseph et al. |
| 5,404,315 | A | 4/1995 | Nakano et al. |
| 5,424,770 | A | 6/1995 | Schmelzer et al. |
| 5,448,568 | A | 9/1995 | Delpuch et al. |
| 5,461,619 | A | 10/1995 | Citta et al. |
| 5,463,620 | A | 10/1995 | Sriram |
| 5,506,844 | A | 4/1996 | Rao |
| 5,532,753 | A | 7/1996 | Buchner et al. |
| 5,579,404 | A | 11/1996 | Fielder et al. |
| 5,625,743 | A | 4/1997 | Fiocca |
| 5,650,825 | A | 7/1997 | Naimpally et al. |
| 5,657,454 | A | 8/1997 | Benbassat et al. |
| 5,666,430 | A | 9/1997 | Rzeszewski |
| 5,729,556 | A | 3/1998 | Benbassat et al. |
| 5,751,723 | A | 5/1998 | Vanden Heuvel et al. |
| 5,778,077 | A | 7/1998 | Davidson |
| 5,802,068 | A | 9/1998 | Kudo |
| 5,822,018 | A | 10/1998 | Farmer |
| 5,831,681 | A | 11/1998 | Takahashi et al. |
| 5,854,658 | A | 12/1998 | Uz et al. |
| 5,864,557 | A | 1/1999 | Lyons |
| 5,877,821 | A | 3/1999 | Newlin et al. |

(Continued)

FOREIGN PATENT DOCUMENTS

| | | | |
|---|---|---|---|
| EP | 1150446 | A2 | 10/2001 |

(Continued)

OTHER PUBLICATIONS

Govindan et al., *Scheduling And IPC Mechanisms For Continuous Media,* 13th ACM Symposium on Operating Systems Principles, 1991, 13 pages.

(Continued)

*Primary Examiner*—Angela A Armstrong

(57) ABSTRACT

Audio level control is provided for compressed audio. Scale factors for the compressed audio are extracted from an MPEG audio data stream, the extracted scale factors are altered without decompressing the compressed audio, and the MPEG audio data stream is updated with the altered scale factors. All of the scale factors in the MPEG audio data stream are altered based on a parameter identifying how the gain levels in the MPEG data stream are to be altered.

33 Claims, 3 Drawing Sheets

U.S. PATENT DOCUMENTS

| | | | | |
|---|---|---|---|---|
| 5,898,675 | A | 4/1999 | Nahumi | |
| 5,912,890 | A | 6/1999 | Park | |
| 5,966,120 | A | 10/1999 | Arazi et al. | |
| 5,987,031 | A | 11/1999 | Miller et al. | |
| 5,991,812 | A | 11/1999 | Srinivasan | |
| 6,047,178 | A | 4/2000 | Frlan | |
| 6,064,676 | A | 5/2000 | Slattery et al. | |
| 6,137,834 | A | 10/2000 | Wine et al. | |
| 6,169,584 | B1 | 1/2001 | Glaab et al. | |
| 6,169,807 | B1 | 1/2001 | Sansur | |
| 6,169,973 | B1 | 1/2001 | Tsutsui et al. | |
| 6,188,439 | B1 | 2/2001 | Kim | |
| 6,195,438 | B1 | 2/2001 | Yumoto et al. | |
| 6,208,666 | B1 | 3/2001 | Lawrence et al. | |
| 6,252,848 | B1 | 6/2001 | Skirmont | |
| 6,259,695 | B1 | 7/2001 | Ofek | |
| 6,298,089 | B1 | 10/2001 | Gazlt | |
| 6,369,855 | B1 | 4/2002 | Chauvel et al. | |
| 6,389,019 | B1 | 5/2002 | Fan et al. | |
| 6,430,233 | B1 | 8/2002 | Dillon et al. | |
| 6,687,247 | B1 | 2/2004 | Wilford et al. | |
| 6,765,867 | B2 | 7/2004 | Shanley et al. | |
| 6,801,886 | B1 | 10/2004 | Pai et al. | |
| 6,931,370 | B1 | 8/2005 | McDowell | |
| 7,035,278 | B2 | 4/2006 | Bertram et al. | |
| 2001/0016048 | A1 | 8/2001 | Rapeli | |
| 2001/0047267 | A1 * | 11/2001 | Abiko et al. | 704/500 |
| 2002/0004718 | A1 | 1/2002 | Hasegawa et al. | |
| 2002/0085584 | A1 | 7/2002 | Itawaki et al. | |
| 2002/0146023 | A1 | 10/2002 | Myers | |
| 2002/0169599 | A1 * | 11/2002 | Suzuki | 704/200.1 |
| 2002/0173864 | A1 | 11/2002 | Smith | |
| 2004/0199933 | A1 | 10/2004 | Ficco | |

FOREIGN PATENT DOCUMENTS

| | | | |
|---|---|---|---|
| GB | 2341745 | | 3/2000 |
| JP | 10 284980 | | 10/1998 |
| JP | 10284960 | A2 | 10/1998 |
| JP | 2001-111969 | | 4/2001 |
| JP | 2001 169248 | | 6/2001 |
| JP | 2001169248 | A2 | 6/2001 |
| WO | WO 9953612 | A1 | 10/1999 |
| WO | WO 01/30086 | | 4/2001 |

OTHER PUBLICATIONS

Bhaskaran, V. Ed—Institute of Electrical and Electronics Engineers: "Mediaprocessing in the Compressed Domain" Digest of Papers of COMPCON (Computer Society Conference) 1996 Technologies for the Information Superhighway. Santa Clara, Feb. 25-28, 1996, Digest of Papers of the Computer Society Computer Conference COMPCON, Los Alamitos, IEEE Comp. Soc. Press, vol. Conf. 41, Feb. 25, 1996, pp. 204-209, XP010160896—ISBN: 0-8186-7414-8 *abstract*, *p. 208, right-hand col., paragraph 3—p. 209, left-hand col., paragraph 1.

Brandenburg, K. et al.: 'ISO-MPEG-1 Audio: A Generic Standard for Coding of High-Quality Digital Audio Journal of the Audio Engineering Society, Audio Engineering Society. New York, US, vol. 42, No. 10, Oct. 1994, pp. 780-792, XP000978167—ISSN: 0004-7554 *abstract*, *p. 785, left-hand col., paragraph 2—p. 786, left-hand col., paragraph 1; figures 2,3.

Hans, M. et al.: "An MPEG Audio Layered Transcoder"—Preprints of Papers Presented at the AES Convention, XX, XX, Sep. 1998, pp. 1-18, XP001014304—*abstract*, *p. 11, paragraph 1.

EPO Communication dated Jul. 26, 2005.

EPO Communication dated Jan. 27, 2006.

EPO Communication dated Jan. 22, 2007.

U.S. Appl. No. 10/660,952, filed Sep. 12, 2003, Thomas H. James, Final Office Action dated Jan. 10, 2008.

U.S. Appl. No. 10/038,174, filed Jan. 3, 2002, Leon J. Stanger, Notice of Allowance dated Jan. 11, 2008.

Smith, Nigel; "Satellite Data Broadcasting—An End to the World-Wide Wait?"; NDS Data Broadcasting Article; 1997 The Institute o Electrical Engineers; published by IEE, Savoy Place, London, U.K.; pp. 6/1-6/11; XP 6502899.

Non-final Office Action dated Jul. 1, 2008 in U.S. Appl. No. 10/660,952, filed Sep. 12, 2003 by Thomas H. James et al.

Japanese Official Letter of Inquiry dated Nov. 11, 2008 in Japanese Patent Application No. 2002-378471 filed Dec. 26, 2002 by Leon Stanger et al.

Non-final Office Action dated Dec. 31, 2008 in U.S. Appl. No. 10/660,952, filed Sep. 12, 2003 by Thomas H. James et al.

* cited by examiner

AUDIO LEVEL CONTROL FOR COMPRESSED AUDIO

CROSS-REFERENCE TO RELATED APPLICATIONS

This application is related to the following applications:

U.S. patent application Ser. No. 10/038,174, filed Jan. 3, 2002;

U.S. parent application Ser. No. 10/192,960, filed Jul. 10, 2002, now U.S. Pat. No. 7,286,473, issued Oct. 23, 2007; and U.S. patent application Ser. No. 10/660,952, filed Sep. 12, 2003.

BACKGROUND OF THE INVENTION

1. Field of the Invention

The present invention relates to audio level control for compressed data.

2. Description of the Related Art

Digital television, such as that provided by DIRECTV®, the assignee of the present invention, is typically transmitted as a digital data stream encoded using the MPEG (Motion Pictures Experts Group) standard promulgated by the ISO (International Standards Organization). MPEG provides an efficient way to represent video and audio in the form of a compressed bit stream.

The MPEG-1 standard is described in a document entitled "Coding of Moving Pictures and Associated Audio for Digital Storage Media at up to about 1.5 MBit/s," ISO/IEC 11172 (1993), which is incorporated by reference herein. The MPEG-2 standard is described in a document entitled "Generic Coding of Moving Pictures and Associated Audio Information," ISO/IEC 13818 (1998), which is incorporated by reference herein.

Even though a satellite broadcaster, DIRECTV® provides its subscribers with local programming, i.e., local television channels, which requires that each of the television channels within a city be encoded into MPEG and statistically-multiplexed at a collection facility, before being transported via common carrier to a broadcast center for uplinking to satellites operated by DIRECTV®. Agreements can be made with other satellite broadcasters and cable operators to share these collection facilities, in order to reduce costs.

In addition, program providers, such as Disney®, Viacom®, HBO®, Showtime®, Starz®, ESPN®, etc., often provide DIRECTV® with a pre-encoded and statistically-multiplexed MPEG data stream. These program providers may ask that the MPEG data stream be passed directly through to DIRECTV® subscribers without decoding and re-encoding.

However, problems can arise in using these different MPEG data streams, due to the fact that the various satellite broadcasters, cable operators and program providers may use different standards that result in different audio levels. For example, DIRECTV® follows the SMPTE (Society of Motion Picture and Television Engineers) recommendation that a 0 dB reference level is at −20 dB from digital full scale, while other satellite broadcasters, cable operators or program providers may operate with a 0 dB reference level that is at −17 dB from digital full scale.

If these different MPEG data streams use one or more different standards, then the broadcast channels resulting therefrom will appear to be either too loud or too soft, as compared to other channels. Thus, there is a need to change the audio levels of an MPEG audio data stream.

There are additional applications where there is need for the ability to change the audio levels of an MPEG data stream.

For example, television production generally runs with a wide dynamic range, providing the ability for the creative programmer to "turn up" the audio during a climax. Also, classical music often runs with a wide dynamic range.

On the other hand, most popular music has its dynamic range severely limited. This limiting of dynamic range is done for many reasons:

1) The artist desires the music to be played loudly.

2) Radio stations often believe that having silence is akin to being off the air.

3) In high-noise listening environment, such as an automobile, stadium or other public venue, it is necessary to have a narrow dynamic range to be heard over the noise.

4) The recording technology imparts a high noise level, e.g. cassette tapes, and a limited dynamic range masks the noise.

5) The playback technology has a limited dynamic range, e.g. battery-operated personal listening devices.

With regard to personal MPEG players, the 0 dB reference level for many of these devices is at −10 dB digital full scale. Consequently, if an MPEG audio data stream uses a 0 dB reference level at −20 dB digital full scale, then the volume control of the device would have to be turned up by 10 dB to compensate. However, there is limited gain range in many of these devices, since they do not support wide dynamic range audio. A better solution, then, is to change the audio levels of the MPEG audio data stream.

In the prior art, a method of altering the audio levels would comprise (1) decode (decompress) the MPEG audio data stream, (2) adjust the gain, and (3) encode (recompress) the MPEG audio data stream. This method is advantageous because commercially-available encoders and decoders may be purchased at a relatively low price. However, this method has many drawbacks, including the injection of a considerable time delay, at least 48 milliseconds (ms), as well as an increase in noise and distortion caused by yet another re-quantization of the audio.

Consequently, there is need for the ability to change audio levels of MPEG audio data streams without decompressing the audio data within the MPEG audio data streams, altering the gain levels of the audio data, and then re-compressing the audio data within the MPEG audio data streams.

SUMMARY OF THE INVENTION

The present invention discloses a method, apparatus and article of manufacture for providing audio level control for compressed audio. Scale factors for the compressed audio are extracted from an MPEG audio data stream, the extracted scale factors are altered without decompressing the compressed audio, and the MPEG audio data stream is updated with the altered scale factors. All of the scale factors in the MPEG audio data stream are altered based on a parameter identifying how the gain levels in the MPEG data stream are to be altered.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings that form a part hereof, and which show, by way of illustration, several embodiments of the present invention. It is understood that other embodiments may be utilized and structural changes may be made without departing from the scope of the present invention.

Overview

The present invention is directed to audio level control for compressed audio. Specifically, the present invention is directed to extracting scale factors for the compressed audio from an MPEG audio data stream, altering the extracted scale factors without decompressing the compressed audio in order to provide audio level control, and updating the MPEG audio data stream with the altered scale factors. All of the scale factors in the MPEG audio data stream are altered based on a parameter identifying how gain levels in the MPEG data stream are to be altered.

Consequently, if an MPEG audio data stream is too loud or too soft, the audio level can be adjusted as desired in order to maintain uniform listening levels. This provides an improvement over prior art techniques that decompress the audio data, alter the gain levels of the audio data, and then recompress the audio data, wherein the decompression and re-compression cycle causes deterioration of the signal quality and delays the audio.

Exemplary Environment

Figure 1:
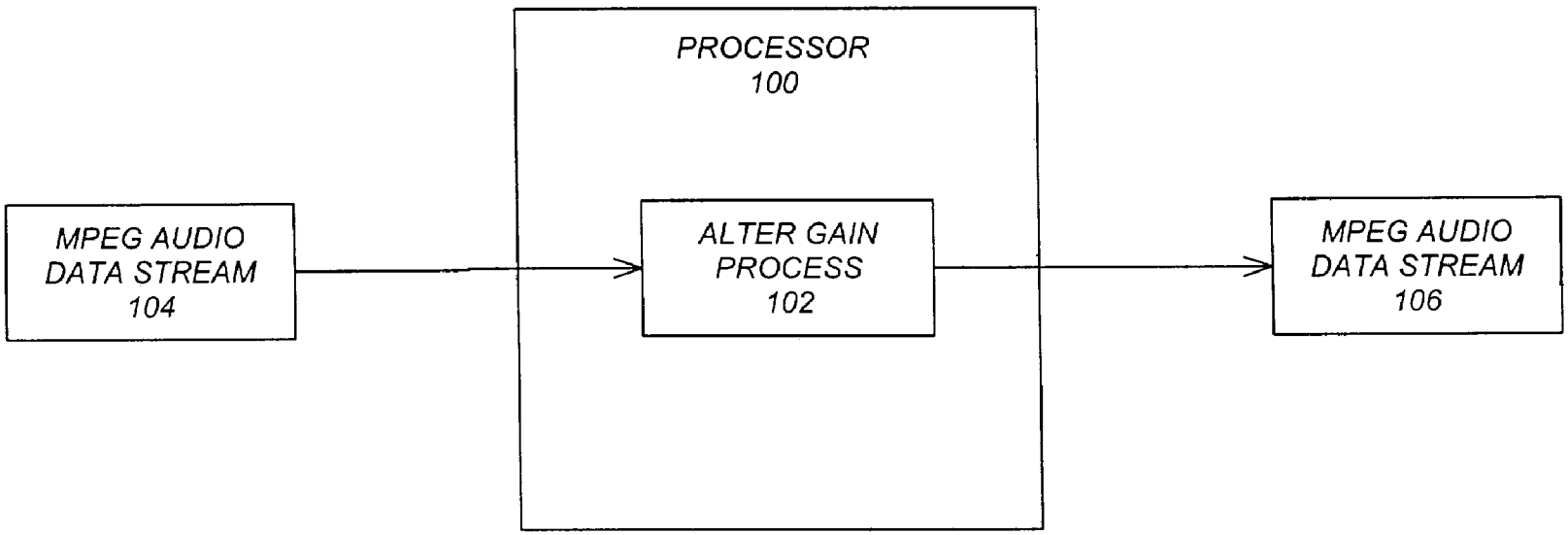
FIG. 1 is a block diagram illustrating an exemplary environment used to implement the preferred embodiment of the invention.

FIG. 1 is a block diagram illustrating an exemplary environment used to implement the preferred embodiment of the invention. In the exemplary environment, a processor 100 may include, inter alia, logic, memory and any number of different peripherals. Preferably, the processor 100 performs an Alter Gain process 102, which performs an audio level change, as well as an audio level detection, directly on an MPEG audio data stream, without decompressing and then re-compressing the audio data within the MPEG auto data stream. Specifically, the Alter Gain process 102 accepts an MPEG audio data stream 104 as input, alters sub-band scale factors found within the MPEG audio data stream 104, updates the MPEG audio data stream 104 with the altered sub-band scale factors, and then outputs the updated MPEG audio data stream 106.

Generally, the Alter Gain process 102 comprises logic, instructions and/or data, that are embodied in or retrievable from a device, medium, carrier, or signal, e.g., the processor 100 itself, a memory, data storage device or remote device coupled to the processor 100, etc. Moreover, these logic, instructions and/or data, when performed, executed, and/or interpreted by the processor 100, cause the processor 100 to perform the steps necessary to implement and/or use the present invention. Consequently, the present invention may be implemented as a method, apparatus, or article of manufacture using software, firmware, hardware, or any combination thereof. Those skilled in the art will recognize many modifications may be made to this configuration without departing from the scope of the present invention.

MPEG Audio Data Stream

Figure 2:
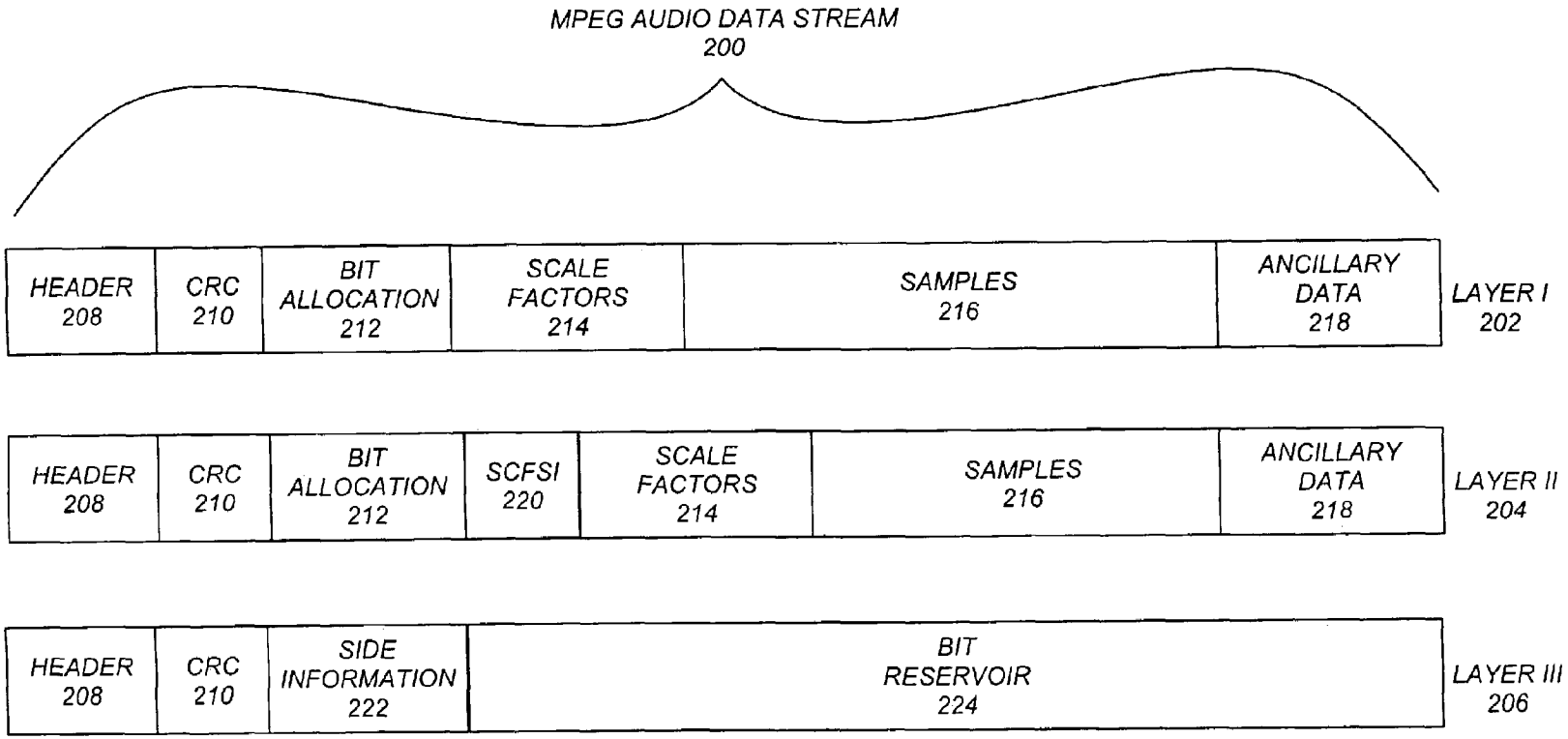
FIG. 2 is a block diagram that illustrates the structure of an MPEG audio data stream.

FIG. 2 is a block diagram that illustrates the structure of an MPEG audio data stream 200. Layers I, II and III within the MPEG audio data stream 200 are shown as separate frames 202, 204 and 206.

Each frame 202, 204 and 206 includes a Header 208, which is followed by an optional cyclic redundancy check (CRC) 210 that is 16 bits in length. The Header 208 is 32 bits and includes the following information:

- Sync Word—12 bits (all 1s)
- System Word—20 bits
  - Version id—1 bit
  - Layer—2 bits
  - Error Protection—1 bit
  - Bit Rate Index—4 bits
  - Sampling Frequency Rate Index—2 bits
  - Padding—1 bit
  - Private—1 bit
  - Mode—2 bits
  - Mode Extension—2 bits
  - Copyright—1 bit
  - Original or copy—1 bit
  - Emphasis—2 bits The CRC 210, if present, is used for detecting errors.

In the frame 202 of Layer I, the CRC 210 is followed by a Bit Allocation 212 (128-256 bits in length), Scale Factors 214 (0-384 bits in length), Samples 216 (384 bits in length), and Ancillary Data 218. In the frame 204 of Layer II, the CRC 210 is followed by a Bit Allocation 212 (26-188 bits in length), Scale Factor Selection Information (SCFSI) 220 (0-60 bits in length), Scale Factors 214 (0-1080 bits in length), Samples 216 (1152 bits in length), and Ancillary Data 218. In the frame 206 of Layer III, the CRC 210 is followed by Side Information 222 (136-256 bits in length) and a Bit Reservoir 224.

The Bit Allocation 212 determines the number of bits per sample for Layer I, or the number of quantization levels for Layer II. Specifically, the Bit Allocation 212 specifies the number of bits assigned for quantization of each sub-band. These assignments are made adaptively, according to the information content of the audio signal, so the Bit Allocation 212 varies in each frame 202, 204. The Samples 216 can be coded with zero bits (i.e., no data are present), or with two to fifteen bits per sample.

The Scale Factors 214 are coded to indicate sixty-three possible values that are coded as six-bit index patterns from "000000" (0), which designates the maximum scale factor, to "111110" (62), which designates the minimum scale factor. Each sub-band in the Samples 216 has an associated Scale Factor 214 that defines the level at which each sub-band is recombined during decoding.

The Samples 216 comprise compressed audio data for each of thirty-two sub-bands. A Layer I frame 202 comprises twelve samples per sub-band. A Layer H frame 204 comprises thirty-six samples per sub-band.

In Layer II 204, the Samples 216 in each frame are divided into three parts, wherein each part comprises twelve samples per sub-band. For each sub-band, the SCFSI 220 indicates whether the three parts have separate Scale Factors 214, or all three parts have the same Scale Factor 214, or two parts (the first two or the last two) have one Scale Factor 214 and the other part has another Scale Factor 214.

During decompression, the Samples 216 are provided to an inverse quantizer, which selects predetermined values according to the Bit Allocation 212 and performs a dequantization operation, wherein the dequantized values are then multiplied by the Scale Factors 214 to obtain denormalized values. Thus, if all the sub-band Scale Factors 214 are changed, the audio level will be altered. Moreover, these changes to the Scale Factors 214 can be made without alteration to the compressed audio data in the sub-bands.

Logic of the Alter Gain Process

Figure 3:
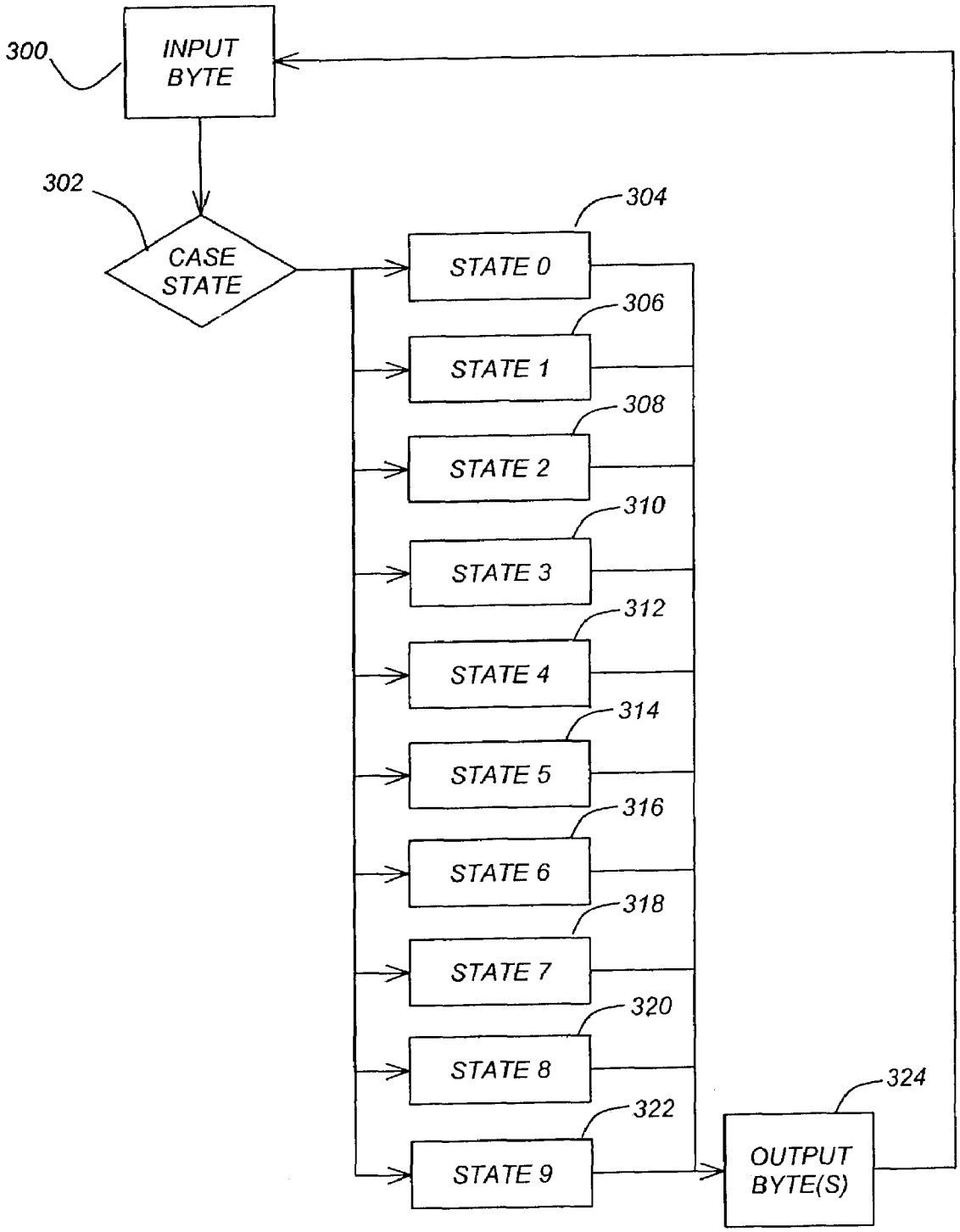
FIG. 3 is a flowchart that illustrates the logic performed by an Alter Gain process in changing scale factors without altering compressed audio data in sub-bands, in order to provide audio level control, according to a preferred embodiment of the present invention.

FIG. 3 is a flowchart that illustrates the logic performed by the Alter Gain process 102 in changing the Scale Factors 214 without altering the compressed audio data in the sub-bands, according to a preferred embodiment of the present invention. In this regard, the Alter Gain process 102 is a filter, wherein the input MPEG audio data stream 104 flows in, the Scale Factors 214 are altered, and the output MPEG audio data stream 106 is updated with the altered Scale Factors 214 (but otherwise remains unchanged from the input MPEG audio data stream 104). In the preferred embodiment, the Alter Gain process 102 incurs only a 2 byte latency for its processing, which causes minimal delay.

Block 300 represents the Alter Gain process 102 accepting one byte at a time from the input MPEG audio data stream 104, as well as a parameter identifying how the gain levels in the input MPEG audio data stream 104 are to be altered.

Block 302 represents the logic of a CASE statement being driven by a current state value, wherein control transfers to Blocks 304-322 depending upon the current state value. After the logic of Blocks 304-322 is performed for the current state, control transfers to Block 324, which outputs a number of bytes as indicated by Blocks 304-322 to the output MPEG audio stream 106. Thereafter, control returns to Block 300 to process the next input byte.

Block 304 represents a state of 0. In this state, the Alter Gain process 102 waits until it receives the first byte of the Sync Word from the Header 208 in the input MPEG audio data stream 104. Specifically, if the input byte is equal to 0xff, then the state is incremented; otherwise, nothing occurs. Thereafter, control transfers to Block 324, which outputs the input byte unchanged.

Block 306 represents a state of 1. In this state, the Alter Gain process 102 examines the input byte to determine whether it is the second byte following the first byte of the Sync Word from the Header 208 in the input MPEG audio data stream 104, wherein the second byte includes least significant 4 bits of the 12-bit Sync Word from the Header 208 and the most significant 4 bits of the 20-bit System Word from the Header 208. If not, then the state is reset to 0 and control transfers to Block 324, which outputs the input byte unchanged. Otherwise, the Layer and Error Protection bits are extracted from the most significant 4 bits of the 20-bit System Word from the Header 208 in the input MPEG audio data stream 104. If the Error Protection is 1 (on), or the Layer is not 2 (MPEG Layer II), then the state is reset to 0 and control transfers to Block 324, which outputs the input byte unchanged. (Note that this embodiment only supports MPEG Layer II audio with no protection.) Otherwise, the state is incremented, and control transfers to Block 324, which outputs the input byte unchanged.

Block 308 represents a state of 2. In this state, the Alter Gain process 102 extracts the Bit Rate Index and Sampling Frequency Rate Index from an additional 8 bits of the 20-bit System Word from the Header 208 in the input MPEG audio data stream 104. The Bit Rate Index, along with the previously-extracted Layer (2), are used as an index into a Bit Rate Table, which determines a bit rate. The Sampling Frequency Rate Index is used as an index into a Sampling Frequency Rate Table, which determines a sampling frequency rate. If the sampling frequency rate is invalid, then the state is reset to 0; otherwise, the state is incremented. Control then transfers to Block 324, which outputs the input byte unchanged.

Block 310 represents a state of 3. In this state, the Alter Gain process 102 extracts the Mode and Mode Extension from the final 8 bits of the 20-bit System Word from the Header 208 in the input MPEG audio data stream 104. With the Mode and Mode Extension, as well as sampling frequency rate obtained from state 2, a number of sub-bands and a number of channels for each sub-band are determined. The state is incremented and control then transfers to Block 324, which outputs the input byte unchanged.

Block 312 represents a state of 4. In this state, the Alter Gain process 102 collects the first byte of the CRC 210 from the input MPEG audio data stream 104. The state is incremented and control then transfers to Block 324, which outputs the input byte unchanged.

Block 314 represents a state of 5. In this state, the Alter Gain process 102 collects the second byte of the CRC 210 in the input MPEG audio data stream 104. The state is incremented and control then transfers to Block 324, which outputs the input byte unchanged.

Note that states 4 and 5 would collect the CRC 210 for later recalculation after the Scale Factors 214 have been altered. However, a discussion of the CRC 210 is omitted from this disclosure.

Block 316 represents a state of 6. In this state, the Alter Gain process 102 extracts the Bit Allocation 210 from the input MPEG audio data stream 104. The number of input bytes received while in this state is determined by the number of sub-bands and the number of Modes. Consequently, the Alter Gain process 102 remains in this state until the entire Bit Allocation 210 has been received. Until that occurs, the state is unchanged and control then transfers to Block 324, which outputs the input byte unchanged. After the entire Bit Allocation 210 is received, the state is incremented and control then transfers to Block 324, which also outputs the input byte unchanged.

Block 318 represents a state of 7. In this state, the Alter Gain process 102 extracts the SCFSI 220 from the input MPEG audio data stream 104. The size of the SCFSI field 220 is based on the number of sub-bands and the Bit Allocation 210. Consequently, the Alter Gain process 102 remains in this state until the entire SCFSI 220 has been received. Until that occurs, the state is unchanged and control then transfers to Block 324, which outputs the input byte unchanged. After the entire SCFSI 220 is received, the state is incremented and control then transfers to Block 324, which also outputs the input byte unchanged.

Block 320 represents a state of 8. In this state, the Alter Gain process 102 extracts the Scale Factors 214 for each sub-band from the input MPEG audio data stream 104, wherein the Scale Factors 214 comprise multipliers for sub-bands of the audio data. Once a Scale Factor 214 has been extracted, it is altered, e.g., incremented or decremented, according to the parameter identifying how the gain levels in the input MPEG audio data stream 104 are to be altered.

Each Scale Factor 214 occupies six bits, which are not byte aligned. Consequently, to alter the Scale Factors 214, there are times when the results from a previous input byte must be held over for an additional input byte, before it can be altered and then output. While Scale Factors 214 are being extracted, the state remains unchanged and control then transfers to Block 324, which outputs the number of bytes for the altered Scale Factors 214 (either 0, 1 or 2), as they become available.

Scale Factors 214 are integers that range from 0 to 63, and are used as multipliers for the sub-band output. The altered Scale Factors 214 are limited and do not wrap. Instead, the altered Scale Factors 214 are limited at either 0 or 63, wherein the altered Scale Factors 214 do not decrease below a minimum (0) and the altered Scale Factors 214 do not increase above a maximum (63).

Having the altered Scale Factors 214 limit while decreasing the gain means that an error would occur at an amplitude level of −140 dB, which is well below the threshold of auditory perception. On the other hand, having the altered Scale Factors 214 limit while increasing the gain, means then all other sub-bands will have their amplitude increased, while this sub-band may not increase as much. However, this effect is often very noticeable, although it is not likely to occur, because it would require increasing the volume to an excessively loud level, i.e., approximately 20 dB above the average level.

As noted above, the Alter Gain process 102 stays in this state until all the Scale Factors 214 have been altered, at which time the state is incremented and control then transfers to Block 324, which outputs the number of bytes for the last remaining altered Scale Factors 214 (either 1 or 2).

Block 322 represents a state of 9. In this state, the Alter Gain process 102 performs no functions. Consequently, the state remains unchanged and control then transfers to Block 324, which outputs the input byte unchanged. The Alter Gain process 102 stays in this state until reset externally. Preferably, the Alter Gain process 102 is reset externally, based on the number of bytes of data, and by reading the bit rate and sampling frequency rate from the MPEG header.

Level Detection

In addition to altering the audio level in the MPEG audio data stream, the present invention can also perform a level detection for the compressed audio, wherein the level detection determines whether audio is even present. This occurs because the Scale Factors 214 in the MPEG audio data stream represent a peak value of the sub-band level over the 24 ms of each packet in the MPEG audio data stream.

The level detection for the compressed audio involves: (1) performing a square root of a sum of squared Scale Factors 214 across a frame 202, 204, (2) normalizing the square root based on a number of channels present in the compressed audio; and (3) comparing the normalized square root against a threshold to determine whether the compressed audio exceeds a specified level. The normalized square root of a sum of squares of the Scale Factors 214 provides a good estimate of the audio level.

Such a function has utility, not as a means to accurately measure audio level, but as a means to determine whether audio is even present. Even though the measured audio level is accurate to only perhaps 5 dB, the present invention can determine that there is audio present. Therefore, if the audio level for some number of sequential packets is determined to be substantially below what would be expected normally (e.g., more than 30 dB below), then an assumption can be made that something upstream has failed.

To accomplish this audio level detection, a number of additions are made to the logic of FIG. 3 above. These additions are described below.

Block 320 uses a table to determine an integer value for each corresponding Scale Factor 214 representing a square of the derived peak analog voltage value. Block 320 stores a sum of these squares across a frame 202 or 204.

Block 322 performs a square root of the sum of the squares stored in Block 320, at a point where the Alter Gain process 102 has completed its processing of a frame 202 or 204. The square root is then normalized, depending on the number of channels present in the compressed audio, which represents the square of the estimated input voltage. The normalized square root is compared against a threshold to determine whether the compressed audio exceeds a specified level, above which an audio channel can be declared as being active.

Moreover, the level detection itself may be used to initiate an alteration in the audio levels, thereby forming a simple automatic gain control. For example, if over some period of time, the audio level is viewed as too low or too high, then the gain level can be adjusted, using the logic of FIG. 3, to bring the audio level to a pre-determined level. This would be performed by Blocks 320 or 322 examining the peak level over some period of time and, if the level is determined to be too low or too high, then altering the gain to a pre-determined level using the logic of FIG. 3. Examining the peak level over a long period of time mitigates the errors in measurement and control.

Advantages

The present invention includes a number of unique features and advantages:

1) Altering the audio level in an MPEG audio data stream must be done without appreciable delay. Generally, a decode and encode of the MPEG audio data stream requires at least 48 ms of delay. For broadcasting, however, the audio is associated with video, and unless additional video delay is injected, it will appear to a viewer that the lips are moving well before the sound is heard, causing a problem with "lip-sync."

2) The present invention proves to be highly efficient computationally. For example, test, software running on a PC varied the audio level of an MPEG audio data stream at more than 20 times real time, where an MPEG decode and encode operated only at real time.

3) Elimination of interim decoder quantization errors. In the prior art, if the decoder only provided 16 bits of resolution, the decoder itself could inject quantization errors into the MPEG audio data stream. This is true if the original MPEG audio data stream was encoded with more than 16 bits of precision (typically 20 or 24 bits). Most decoders are built to maintain at most 16 bits of precision. If the audio level is "turned up" after a 16 bit decode, the encoder following sees an elevated noise floor caused by truncation errors in the decoder. With this invention, if the original MPEG audio encoding was done with greater than 16 bits of precision, the gain can be increased while keeping the noise floor on a 16 bit decoder at an optimum level, actually increasing signal to noise ratios.

CONCLUSION

The foregoing description of the preferred embodiment of the invention has been presented for the purposes of illustration and description. It is not intended to be exhaustive or to limit the invention to the precise form disclosed. Many modifications and variations are possible in light of the above teaching.

For example, while the foregoing disclosure presents an embodiment of the present invention as it is applied to a satellite transmission system or personal MPEG player, the present invention can be applied to any application that uses MPEG audio. Moreover, although the present invention is described in terms of MPEG audio, it could also be applied to other compression schemes, such as Dolby® AC-3. Finally, although specific logic is described herein, those skilled in the art will recognize that other logic may accomplish the same result, without departing from the scope of the present invention.

It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of audio level control for compressed audio in a data stream, comprising:

(a) extracting, in a processor, scale factors for the compressed audio from the data stream;

(b) performing, in the processor, a level detection for the compressed audio by: (1) determining a square of a derived peak analog voltage value for each of the scale factors; (2) performing a square root of a sum of the squares across a frame; (3) normalizing the square root based on a number of channels present in the compressed audio; and (4) comparing the normalized square root against a threshold to determine whether the compressed audio exceeds a specified level;

(c) altering, in the processor, only the extracted scale factors, based on the level detection, without decompressing the compressed audio or altering any other portion of the data stream; and (d) updating, in the processor, the data stream with the altered scale factors, wherein the data stream otherwise remains unchanged.

2. The method of claim 1, wherein all of the scale factors in the data stream are altered.

3. The method of claim 1, wherein the scale factors in the data stream are altered based on a parameter identifying how the gain levels in the data stream are to be altered.

4. The method of claim 1, further comprising:

(1) extracting a bit rate index from the data stream in order to determine a bit rate;

(2) extracting a sampling frequency rate index from the data stream in order to determine a sampling frequency rate;

(3) extracting a mode and mode extension from the data stream;

(4) determining a number of sub-bands and a number of channels for each sub-band using the bit rate, sampling frequency rate, mode and mode extension;

(5) extracting a bit allocation based on the number of sub-bands and the number of modes;

(6) extracting a scale factor selection information based on the number of sub-bands and the bit allocation;

(7) extracting the scale factors for each sub-band based on the scale factor selection information; and (8) altering the extracted scale factors for each sub-band according to the parameter identifying how the gain levels of the compressed audio in the data stream are to be altered.

5. The method of claim 1, wherein the scale factors are multipliers for sub-bands of the audio data.

6. The method of claim 1, wherein the altering step further comprises limiting the scale factors.

7. The method of claim 6, wherein the altered scale factors do not wrap.

8. The method of claim 6, wherein the altered scale factors do not decrease below a minimum.

9. The method of claim 6, wherein the altered scale factors do not increase above a maximum.

10. The method of claim 1, wherein the steps (a), (b), (c) and (d) incur only a two byte latency.

11. The method of claim 1, wherein the level detection determines whether audio is present.

12. An apparatus for audio level control for compressed audio in a data stream, comprising:

(a) means, performed by a processor, for extracting scale factors for the compressed audio from the data stream;

(b) means, performed by the processor, for performing a level detection for the compressed audio by; (1) means for determining a square of a derived peak analog voltage value for each of the scale factors; (2) means for performing a square root of a sum of the squares across a frame; (3) means for normalizing the square root based on a number of channels present in the compressed audio; and (4) means for comparing the normalized square root against a threshold to determine whether the compressed audio exceeds a specified level;

(c) means, performed by the processor, for altering only the extracted scale factors, based on the level detection, without decompressing the compressed audio or altering any other portion of the data stream; and (d) means, performed by the processor, for updating the data stream with the altered scale factors, wherein the data stream otherwise remains unchanged.

13. The apparatus of claim 12, wherein all of the scale factors in the data stream are altered.

14. The apparatus of claim 12, wherein the scale factors in the data stream are altered based on a parameter identifying how the gain levels in the data stream are to be altered.

15. The apparatus of claim 12, further comprising:

(1) means for extracting a bit rate index from the data stream in order to determine a bit rate;

(2) means for extracting a sampling frequency rate index from the data stream in order to determine a sampling frequency rate;

(3) means for extracting a mode and mode extension from the data stream;

(4) means for determining a number of sub-bands and a number of channels for each sub-band using the bit rate, sampling frequency rate, mode and mode extension;

(5) means for extracting a bit allocation based on the number of sub-bands and the number of modes;

(6) means for extracting a scale factor selection information based on the number of sub-bands and the bit allocation;

(7) means for extracting the scale factors for each sub-band based on the scale factor selection information; and (8) means for altering the extracted scale factors for each sub-band according to the parameter identifying how the gain levels of the compressed audio in the data stream are to be altered.

16. The apparatus of claim 12, wherein the scale factors are multipliers for sub-bands of the audio data.

17. The apparatus of claim 12, wherein the means for altering further comprises means for limiting the altered scale factors.

18. The apparatus of claim 17, wherein the altered scale factors do not wrap.

19. The apparatus of claim 17, wherein the altered scale factors do not decrease below a minimum.

20. The apparatus of claim 17, wherein the altered scale factors do not increase above a maximum.

21. The apparatus of claim 12, wherein the means (a), (b) (c) and (d) incur only a two byte latency.

22. The apparatus of claim 12, wherein the level detection determines whether audio is present.

23. An article of manufacture comprising a storage device embodying instructions that, when read and executed by a processor, results in the processor performing a method of audio level control for compressed audio in a data stream, the method comprising:

(a) extracting, in a processor, scale factors for the compressed audio from the data stream;

(b) performing, in the processor, a level detection for the compressed audio by: (1) determining a square of a derived peak analog voltage value for each of the scale factors; (2) performing a square root of a sum of the squares across a frame; (3) normalizing the square root based on a number of channels present in the compressed audio; and (4) comparing the normalized square root against a threshold to determine whether the compressed audio exceeds a specified level;

(c) altering, in the processor, only the extracted scale factors, based on the level detection, without decompressing the compressed audio or altering any other portion of the data stream; and (d) updating, in the processor, the data stream with the altered scale factors, wherein the data stream otherwise remains unchanged.

24. The article of manufacture of claim 23, wherein all of the scale factors in the data stream are altered.

25. The article of manufacture of claim 23, wherein the scale factors in the data stream are altered based on a parameter identifying how the gain levels in the data stream are to be altered.

26. The article of manufacture of claim 23, the method further comprising:

(1) extracting a bit rate index from the data stream in order to determine a bit rate;

(2) extracting a sampling frequency rate index from the data stream in order to determine a sampling frequency rate;

(3) extracting a mode and mode extension from the data stream;

(4) determining a number of sub-bands and a number of channels for each sub-band using the bit rate, sampling frequency rate, mode and mode extension;

(5) extracting a bit allocation based on the number of sub-bands and the number of modes;

(6) extracting a scale factor selection information based on the number of sub-bands and the bit allocation;

(7) extracting the scale factors for each sub-band based on the scale factor selection information; and (8) altering the extracted scale factors for each sub-band according to the parameter identifying how the gain levels of the compressed audio in the data stream are to be altered.

27. The article of manufacture of claim 23, wherein the scale factors are multipliers for sub-bands of the audio data.

28. The article of manufacture of claim 23, wherein the altering step further comprises limiting the altered scale factors.

29. The article of manufacture of claim 28, wherein the altered scale factors do not wrap.

30. The article of manufacture of claim 28, wherein the altered scale factors do not decrease below a minimum.

31. The article of manufacture of claim 28, wherein the altered scale factors do not increase above a maximum.

32. The article of manufacture of claim 23, wherein the steps (a), (b), (c) and (d) incur only a two byte latency.

33. The article of manufacture of claim 23, wherein the level detection determines whether audio is present.

* * * * *